United States Patent [19]

Lundmark

[11] 4,293,014

[45] Oct. 6, 1981

[54] BARKING DRUM

[75] Inventor: Lorentz Lundmark, Ersmark, Sweden

[73] Assignee: Skega Aktiebolag, Ersmark, Sweden

[21] Appl. No.: 87,563

[22] Filed: Oct. 23, 1979

[30] Foreign Application Priority Data

Feb. 11, 1978 [SE] Sweden ..... 7811372

[51] Int. Cl.[3] ..... B02C 17/22

[52] U.S. Cl. ..... 144/208 B; 241/183

[58] Field of Search ..... 144/208 R, 208 B; 241/102, 182, 183

[56] References Cited

U.S. PATENT DOCUMENTS 1,207,174 12/1916 Johnson ..... 144/208 B
1,986,530 1/1935 Read ..... 144/208 B
3,262,477 7/1966 O'Brien ..... 144/208 B
4,141,511 2/1979 Anderson ..... 241/183

FOREIGN PATENT DOCUMENTS 2112889 3/1971 Fed. Rep. of Germany ..... 241/183

*Primary Examiner*—W. D. Bray
*Attorney, Agent, or Firm*—Cushman, Darby & Cushman

[57] ABSTRACT

This invention relates to an attachment device for wear rubber elements in barking drums and has as its object simplifying the mounting of such elements by avoiding unnecessary drilling of mounting holes.

According to the invention the wear rubber elements are retained at their longitudinal edge sections by mounting bars, for the anchoring of which in the shell plate of the drum bark outlets are utilized.

7 Claims, 3 Drawing Figures

BARKING DRUM

Figure 1:
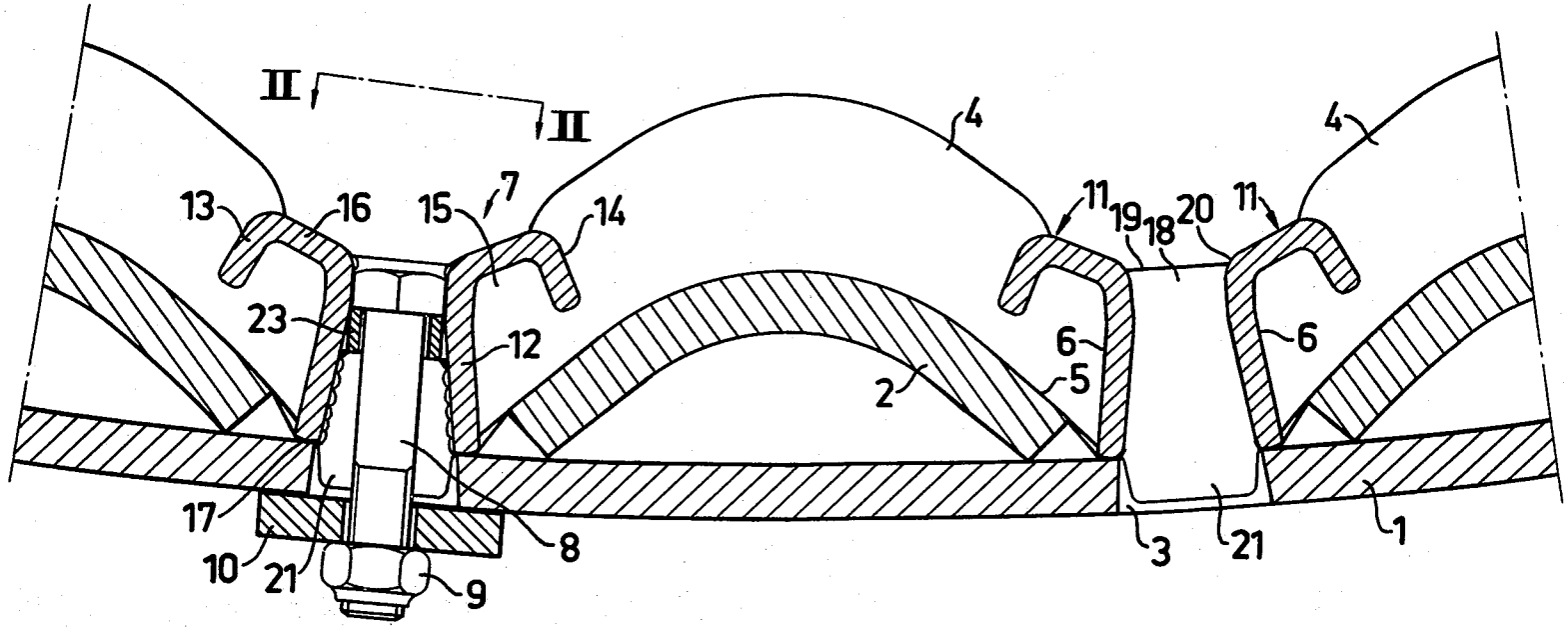

This invention relates to a device at barking drums, more precisely to a device for attaching wear rubber elements in rotary barking drums, which on the inside of their shell plate are provided with longitudinal barking irons acting as lifters and between said barking irons have bark outlets in the form of spaced oblong openings extending through the shell plate.

Into such rotary barking drums the logs to be barked are charged at one end and discharged through the opposed end of the drum. The logs are maintained moving substantially in parallel with each other by the rotation of the drum and by means of the barking irons acting as lifters. Said barking irons normally are metal sheet strips of substantially arc-shaped cross-section and welded on the shell plate at their two longitudinal edges. The barking is effected by utilizing the friction, which is brought about by the rotary movement of the logs relative to each other both between the logs and against the shell plate of the drum, above all against the barking irons thereon. The barking irons hereby are subjected to continuous wear, which in the course of time requires their replacement and/or repair.

In a barking drum of, for example, 60 m length the total length of the barking irons can amount to more than 2.5 kilometers. Exchange and repair of worn barking irons understandably is both tedious and expensive, but due to the absence of better alternatives so far worn barking irons had to be exchanged or repaired, for example by surfacing. The maintenance costs consequently are high, and the operation shut-downs many.

In order to eliminate or at least reduce these problems, however, experiments have been made latterly in new barking drums to manufacture the barking members acting as lifters of wear rubber, and in already existing barking drums to line the barking irons with wear rubber. These experiments have had positive results in several respects. It was found, for example, that the use of wear rubber elements as barking members or as wear lining on existing barking irons not only substantially increases the service life and thereby lowers the maintenance costs and reduces the number of shutdowns, but that also the noise level is lowered considerably, which is an essential advantage not the least from a work environment aspect. No deterioration of the barking effect has been observed at the experiments, but there has been observed an increasing clogging tendency of the bark outlets, especially in existing barking drums, but also in new ones provided with barking members of wear rubber. One reason of the clogging tendency is found in the rubber material proper, the surface of which is rougher than that of steel material, for example, and thereby renders it more difficult for the bark to pass out through the outlets. Another reason is the increase in height of the barking irons due to their lining with or manufacture of wear rubber. This greater height implies a longer traveling path for the bark to arrive at the outlet openings proper in the shell plate and thereby increases the risk for the bark to get jammed.

Another rather essential problem was found to be the attaching proper of the wear rubber elements in the barking drums, especially on the existing barking irons of steel. Heretofore, the same kind of attachment means as for rubber lifters in mills and the like have been used. Such means consist in principle of a T-shaped mounting bar vulcanized on the lower surface of the wear rubber elements, and of suitably spaced mounting bolts to be tightened by nuts on the outer surface of the drum and thereby to clamp the wear rubber elements against the barking members. This requires for every mounting bolt holes to be drilled not only through the barking iron, but also through the shell plate. This very tedious and expensive work is desired to be avoided, but so far no one has succeeded therewith.

The object of the present invention, therefore, is to solve the aforesaid problems in such a way, that clogging of the bark outlets is eliminated to the greatest possible extent, and that at the same time the wear rubber elements in the barking drum can be attached more simply.

This object is achieved in that the device according to the present invention has been given the characterizing features defined in the attached claims. One of the essential characterizing features of the invention can be said in principle to be that the wear rubber elements are retained at their longitudinal edge portions by mounting bars, and that the bark outlet openings are utilized for securing the bars in the shell plate.

Figure 2:
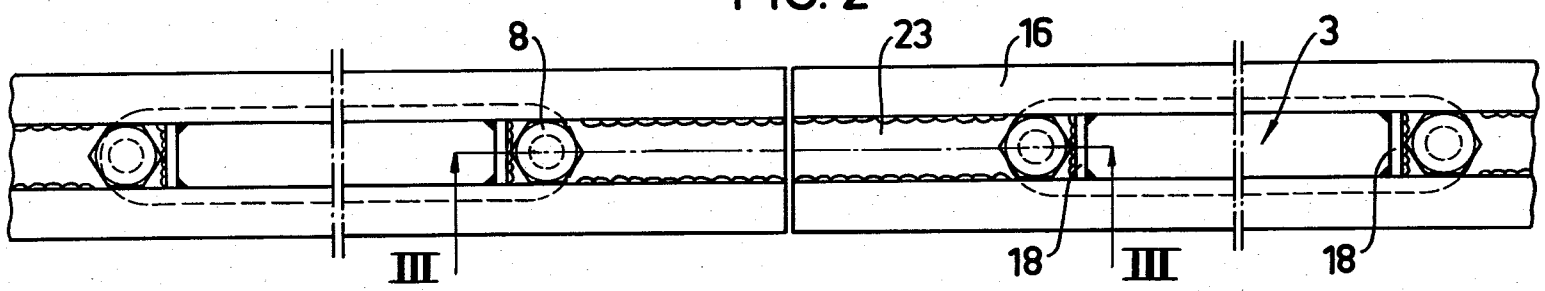
Figure 3:
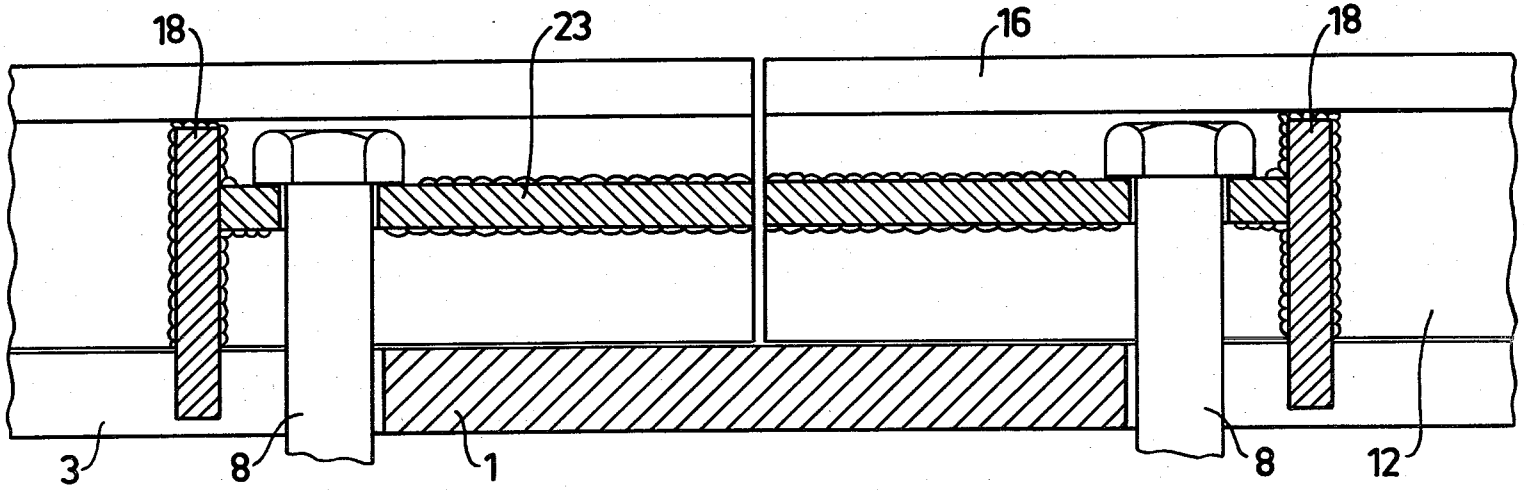

The invention is described in greater detail in the following, with reference to the accompanying drawings, in which FIG. 1 is a section through a shell portion of a barking drum lined with wear rubber according to the invention, FIG. 2 is a view substantially along the line II—II in FIG. 1, and FIG. 3 is a section substantially along the line III—III in FIG. 2.

In the drawings, the numeral 1 designates the shell plate of an existing barking drum lined internally with wear rubber according to the invention and on said lining provided with longitudinal barking irons, which consist of sheet metal strips bent to arc shape and welded on the shell plate 1 and acting as lifters. In the shell plate 1, between the barking irons 2, bark outlets are provided, which have the form of spaced oblong openings 3 and through which not only bark but also gravel and other particles loosened during the barking operation are discharged.

Every such barking iron 2 shown in the drawings is provided with a lining 4 consisting of wear rubber and preferably assembled of several sections. The lining follows with its lower surface 5 substantially the contour of the existing barking iron and has such a width as to entirely cover the barking iron 2, but terminates with its edge sides 6 at some distance from the outlet openings 3. The lining 4 can have the cross-sectional shape shown only by way of example in FIG. 1, but other cross-sectional shapes also are fully suitable for enabling the lining to meet the requirement of acting as barking member and wear lining.

The linings 4 are held safely in place on the barking irons 2 by attachment means 7 according to the present invention, which are positioned between the linings 4 and located each above a row of outlet openings 3 and connected to the shell plate 1 by mounting bolts 8 extending through the outlet openings 3 and by associated nuts 9 with a washer 10 laid between the nut 9 and the shell plate 1. According to the present invention, thus, the outlet openings 3 of the barking drum are utilized for securing the linings 4, thereby also rendering the drilling of special holes for securing the linings unnecessary to a large extent. Every attachment means comprises two mounting bars 11, which extend along the entire length of the lining and are made of metallic material, for example steel or stainless steel, or another smooth but strong material. Each mounting bar has a support portion 12 and a mounting flange 13 to sealingly engage in a longitudinal groove 14 in the edge portion 15 of an adjacent lining. Said groove is substantially in parallel with and spaced from the edge side 6 of the lining which sealingly abuts the support portion 12 of the associated mounting bar. Said space is bridged by an inclined portion 16, which connects the support portion of the mounting bar and the mounting flange to each other. The said mounting bars and the said portions 16, which in FIG. 1 are inclined downward, are arranged so as to act as slide planes, which actively and efficiently assist in causing the bark pieces loosened at the barking to slide down between the mounting bars 11 without getting jammed and further out through the outlet openings 3, on both sides of which the mounting bars 11 with their support portions 12 are located, and the end surfaces 17 of said portions 12 rest against the shell plate 1.

The two mounting bars 11 in each attachment means 7 are so interconnected that the width between their support portions 12 increases toward the outlet openings 3, but this width must not exceed the smallest width of the radially outward widening outlet openings at the inside of the shell plate. The distance between the mounting bars 11 is maintained by transverse plates 18, which are connected to the support portions 12 of the bars and should terminate with their upper edge 19 on the same level as the lower edge 20 of the slide plane, and which downwardly can terminate on the same level as the inside surface of the shell plate. There, thus, the plates have their greatest width, but preferably should be provided with an extension 21 tapering from the greatest width of the plates, as shown in the drawings. Said extension 21, the length of which must not exceed the thickness of the shell plate, acts as a guide pin, which in the mounting operation ensures the attachment means 7, and thereby the linings 4, automatically to be centered in relation to the outlet openings 3. Every transverse plate 18 further is located so spaced from an end of an outlet opening 3, that the necessary space for introducing a mounting bolt 8 is formed therebetween, as shown especially in FIGS. 2 and 3. Two such plates 18 located each at one end of one and the same outlet opening 3 thereby define between themselves a channel extending to the outlet opening lying beneath. Between the transverse plates 18 each located at the end of an outlet opening 3, however, suspension plates 23 for the mounting bolts 8 are provided which are located slightly below the upper edge 19 of the transverse plates and are connected to the plates 18 as well as to the support portions 12 of the mounting bars. The mounting bolts 8 are prevented from rotating at the tightening of the nuts 9 in that their heads are locked between the support portions 12 of the mounting bars.

The present invention, thus, has brought about an attachment device for wear rubber elements in barking drums by which simple and rapid but yet correct mounting is possible in that a.o. the outlet openings of the barking drums can be utilized, and which at the same time is of such a nature, that it does not tend to cause clogging of the outlet openings, but rather prevents such clogging. Though not mentioned specifically, the present attachment device, of course, can be used also for attaching barking members consisting of wear rubber in new barking drums, and also the portion, which in FIG. 1 is located between the shell plate 1 and the lining 4 shown may consist of wear rubber. The height of the attachment device can be reduced slightly, because the necessary distance between the point of the mounting flange and the shell plate yet is obtained.

The present invention is not restricted to the embodiment described above and shown in the drawings, but can be altered and modified in many different ways within the scope of the invention idea defined in the attached claims.

In order to protect the attachment device, which can be assembled of sections, and the mounting bars thereof against wear and corrosion, the device or parts thereof can be provided with a coat of an elastomer material.

What I claim is:

1. In a rotary barking drum having a shell plate, internal longitudinal laterally spaced-apart barking means, longitudinally spaced-apart bark outlets in the shell plate at locations between the barking means and wear rubber elements on the barking means, an improved device for attaching the wear rubber elements comprising: pairs of laterally spaced-apart mounting bars located parallel to the barking means and inside the shell plate between the barking means so as to form channels extending between the mounting bars to the respective bark outlets, said channels having widths which increase toward the bark outlets, said mounting bars having flanges which engage in grooves in adjacent rubber wear elements and thereby retain the elements against the barking means; means connecting the mounting bars of each pair together; and means attaching each pair of mounting bars to the shell plate, said attaching means including elements extending through the bark outlets and locked against the outside of the bark outlets.

2. Apparatus as in claim 1 wherein said channels have a greatest width at their portion located closest to the bark outlets, which width does not exceed the smallest width of the outlet openings.

3. Apparatus as in claim 1 or claim 2 wherein said mounting bars are inclined from the mounting flanges to form slide planes which are inclined toward the channels to assist in causing bark pieces to enter the channels.

4. Apparatus as in claim 1 or claim 2 including transverse plates disposed in said channels at longitudinally spaced-apart locations so as to define channel ends.

5. Apparatus as in claim 4 wherein the ends of said transverse plates nearest the bark outlets form guide pins for centering the respective pair of mounting bars during assembly.

6. Apparatus as in claim 1 or claim 2 wherein said elements which extend through the bark outlets are suspended on suspension plates located between the mounting bars, said suspension plates extending longitudinally substantially between the bark outlets.

7. A rotary barking drum comprising a shell plate, internal longitudinal laterally spaced-apart barking means, longitudinally spaced-apart bark outlets in the shell plate at locations between the barking means and means for attaching the barking means on the inside of the shell plate, said barking means being in the form of wear rubber elements and said means for attaching said barking rubber elements comprising pairs of laterally spaced-apart mounting bars located parallel to the barking irons and inside the shell plate between the barking irons so as to form channels extending between the mounting bars to the respective bark outlets, said channels having widths which increase toward the bark outlets, said mounting bars having flanges which engage in grooves in adjacent rubber wear elements and thereby retain the elements against the barking means; means connecting the mounting bars of each pair together; and means attaching each pair of mounting bars to the shell plate, said attaching means including elements extending through the bark outlets and locked against the outside of the bark outlets.

* * * * *